US005600891A

United States Patent [19]

Orgal

[11] Patent Number: 5,600,891

[45] Date of Patent: Feb. 11, 1997

[54] POLY-SCISSORS DEVICE

[76] Inventor: Daniel Orgal, Bayit 49, 90855 Shoeva, Israel

[21] Appl. No.: 539,796

[22] Filed: Oct. 5, 1995

[51] Int. Cl.[6] ..... B26B 13/00

[52] U.S. Cl. ..... 30/226; 30/229; 30/260

[58] Field of Search ..... 30/145, 146, 226, 30/229, 254, 256, 257, 260, 341, 227; D8/5

[56] References Cited

U.S. PATENT DOCUMENTS

| | | | |
|---|---|---|---|
| D. 251,232 | 3/1979 | Yamamoto | D8/5 |
| 550,483 | 11/1895 | Carrier | 30/226 |
| 932,472 | 8/1909 | Jewart | 30/229 |
| 1,012,918 | 12/1911 | Roelants et al. | 30/227 |
| 1,345,882 | 7/1920 | Repass | 30/229 |
| 1,715,898 | 6/1929 | Carri | 30/227 |
| 2,840,905 | 7/1958 | Geiger | 30/226 |

*Primary Examiner*—Hwei-Siu Payer
*Attorney, Agent, or Firm*—Mark M. Friedman

[57] ABSTRACT

A poly-scissors device and a scissors connector, both aimed at simultaneously cutting two or more cuts in a medium, which cuts are at a constant distance from one another along their length. The poly-scissors includes two elements, each of which includes a spacer, two cutting ends and an operating end. The cutting ends are connected to the spacer in a substantially parallel and spaced apart orientation and the operating end is connected to the spacer in an opposite direction. The first cutting end of the first element is pivotally connected to the first cutting end of the second element while the second cutting end of the first element is pivotally connected to the second cutting end of the second element. The scissors connector is aimed at substantially parallel connecting at least two pairs of scissors, each of which has a pair of handles. The scissors connector includes two connecting members which connect the two pairs of handles. The first and the second connecting members include a first and a second operating ends attached to a first and a second connectors, respectively. The first connector connects the first handles in a spaced apart and substantially parallel orientation and the second connector connects the second handles in a spaced apart and substantially parallel orientation.

12 Claims, 4 Drawing Sheets

POLY-SCISSORS DEVICE

FIELD AND BACKGROUND OF THE INVENTION

The present invention relates to scissors and shears in general and, more particularly, to a poly-scissors device and to a scissors connector, both aimed at simultaneously cutting two or more cuts in a medium such as a sheet of paper, which cuts are at a constant and predetermined distance from one another, along their length.

Referring now to FIG. 1, a pair of scissors, generally referred to as scissors 100, is typically made of a first member 102*a* pivotally connected via a hinge 101 (e.g., a simple hinge or an imaginary hinge) to a second member 102*b*, each of members 102*a* and 102*b* has a cutting end 104*a* and 104*b*, and an operating end 107*a* and 107*b*, ,respectively. Cutting ends 104*a* and 104*b* of members 102*a* and 102*b*, each having a sharp edge (i.e., a blade), 105*a* and 105*b*, respectively, form the cutting side 106 of scissors 100, whereas operating ends 107*a* and 107*b* of members 102*a* and 102*b* form the operating side 108 of scissors 100. Operating ends 107*a* and 107*b* of each of members 102*a* and 102*b* typically include oval-tinged handles 110*a* and 110*b*, respectively, to enable the thumb and another finger or fingers (e.g., the pointing finger) of a user to comfortably rotate cutting ends 104*a* and 104*b* of members 102*a* and 102*b* one relative to the other, around hinge 101, thereby to cut through a medium, such as, for example, a sheet of paper. When thus operated, scissors 100 create a continuous cut, either straight or curved, in the medium.

Nevertheless, it is some times required to create two or more cuts in the same medium, which cuts are desired to have a constant linear distance one from the other, such as, when a sheet of paper is cut to linear or curved ribbons. When employing a conventional pair of scissors (such as scissors 100 described hereinabove and in FIG. 1) for this purpose, at least two independent cuts are to be applied successively to the medium. Yet, specially if the cutting of curved ribbons is desired, precision is difficult to achieve.

There is thus a widely recognized need for, and it would be highly advantageous to have, a poly-scissors device and a scissors connector, both of which enable simultaneously cutting two or more cuts in a medium, which cuts are at a constant and predetermined distance from one another, along their length.

SUMMARY OF THE INVENTION

According to the present invention there is provided a poly-scissors device and a scissors connector, both aimed at simultaneously cutting two or more cuts in a medium, which cuts are at a constant and predetermined distance from one another along their length.

According to further features in preferred embodiments of the invention described below, the poly-scissors device includes a first element and a second element, wherein: (a) each of the first and second elements includes a spacer, a first cutting end, a second cutting end, and an operating end, the first and the second cutting ends connected to the spacer in a substantially parallel spaced apart orientation and the operating end connected to the spacer in an opposite direction relative to the first and second cutting ends; and (b) the first cutting end of the first element is pivotally connected to the first cutting end of the second element, and the second cutting end of the first element is pivotally connected to the second cutting end of the second element.

According to still further features in the described preferred embodiments each of the first and the second elements further includes at least one additional cutting end connected to the spacer and situated substantially parallel to the first and the second cutting ends.

According to still further features in the described preferred embodiments the first and second cutting ends, the spacer and the operating end of each of the first and second elements are a single part.

According to still further features in the described preferred embodiments the first, the second, the at least the one additional cutting end, the spacer and the operating end of each of the first and second elements are a single part. According to still further features in the described preferred embodiments the first and second cutting ends, the spacer and the operating end of each of the first and second elements are fixedly attached to one another. According to still further features in the described preferred embodiments the first, the second, the at least one additional cutting end, the spacer and the operating end of each of the first and second elements are fixedly attached to one another. According to still further features in the described preferred embodiments the first and second cutting ends of each of the first and second elements are a first part, the spacer and the operating end of each of the first and second elements are a second part, the first and second parts are fixedly attached to one another. According to still further features in the described preferred embodiments the first, the second and the at least one additional cutting end of each of the first and second elements are a first part, the spacer and the operating end of each of the first and second elements are a second part, the first and second parts are fixedly attached to one another. According to still further features in the described preferred embodiments the first and second cutting end of each of the first and second elements are a first part, the spacer and the operating end of each of the first and second elements are a second and a third part, respectively, the first, second and third parts are fixedly attached to one another.

According to still further features in the described preferred embodiments the first, the second and the at least one additional cutting end of each of the first and second elements are a first part, the spacer and the operating end of each of the first and second elements are a second and a third part, respectively, the first, second and third parts are fixedly attached to one another.

According to still further features in the described preferred embodiments the first and second cutting ends of each of the first and second elements are movable one relative to the other along the first and second spacers, respectively.

According to still further features in the described preferred embodiments the first, the second and the at least one additional cutting end of each of the first and second elements are movable one relative to the others along the first and second spacers, respectively.

According to the present invention there is also provided a scissors connector aimed at substantially parallel connecting at least two pairs of scissors each having a first handle and a second handle.

According to further features in preferred embodiments of the invention described below, the scissors connector includes a first and a second connecting members, the first and second connecting members connecting the first handles and the second handles of the at least two pairs of scissors, respectively.

According to still further features in the described preferred embodiments the first and the second connecting members includes a first and a second operating ends attached to a first and a second connectors, respectively, the first connector connects the first handles of the at least two pairs of scissors in a spaced apart and substantially parallel orientation, and the second connector connects the second handles of the at least two pairs of scissors in a spaced apart and substantially parallel orientation.

According to still further features in the described preferred embodiments each of the first and second connectors is threaded.

According to still further features in the described preferred embodiments the scissors connector further includes: (a) rotation preventing members being situated within each of the first and the second handles of each of the at least two pairs of scissors; (b) nuts for strengthening the substantially parallel connection of the at least two pairs of scissors.

The present invention successfully addresses the shortcomings of the presently known configurations by providing a poly-scissors device and a scissors connector, both capable of simultaneously cutting two or more cuts, which cuts are at a constant distance from one another along their length.

BRIEF DESCRIPTION OF THE DRAWINGS

The invention herein described, by way of example only, with reference to the accompanying drawings, wherein.

DESCRIPTION OF THE PREFERRED EMBODIMENTS

The present invention is of a poly-scissors device and of a scissors connector, both enable simultaneously cutting two or more cuts in a medium, which cuts are at a constant distance from one another along their length. The poly-scissors device and the scissors connector of the present invention can be used to cut a medium such as, for example a sheet of paper, into linear and/or curved ribbons, characterized by a substantially constant width, in a single operation.

The principles and operation of a scissors device and a scissors connector according to the present invention may be better understood with reference to the drawings and accompanying descriptions.

Figure 2:
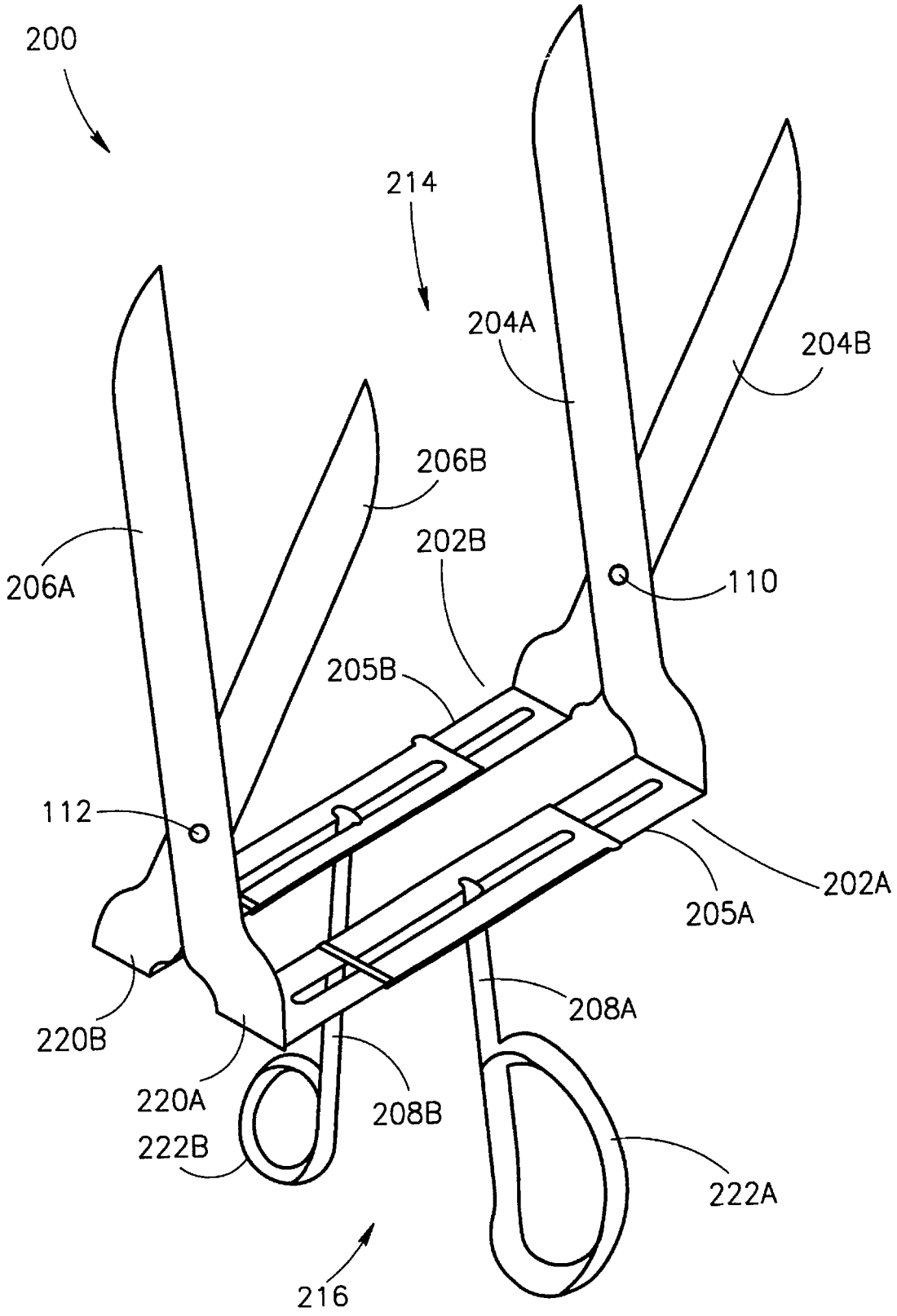
FIG. 2 is a perspective view of a basic configuration of a poly-scissors device, according to the present invention.

Referring now to the drawings, FIG. 2 illustrates a basic configuration of a poly-scissors device, according to the present invention, generally referred to as 200. As shown in FIG. 2, poly-scissors device 200 (a bi-scissors device in the example given in FIG. 2) includes a first element 202*a* and a second element 202*b*. Each of elements 202*a* and 202*b* includes a first cutting end, 204*a* and 204*b*, a second cutting end, 206*a* and 206*b*, a spacer 205*a* and 205*b* and an operating end, 208*a* and 208*b*, respectively. Cutting ends 204*a* and 206*a* of first element 202*a* are attached spaced apart and substantially parallel to one another to first spacer 205*a*. Cutting ends 204*b* and 206*b* of second element 202*b* are similarly attached to second spacer 205*b*. Operating ends 208*a* and 208*b* are attached to spacers 205*a* and 205*b* from an opposite direction, respectively. First cutting ends 204*a* and 204*b* of elements 202*a* and 202*b*, respectively, are pivotally connected to one another via a first hinge 110. Similarly, second cutting ends 206*a* and 206*b* of elements 202*a* and 202*b*, respectively, are pivotally connected to one another via a second hinge 112. Each of hinges 110 and 112 may be a simple hinge or an imaginary hinge. First cutting ends 204*a* and 204*b* and second cutting ends 206*a* and 206*b* form a bi-cutting side 214 of poly-scissors device 200, and operating ends 208*a* and 208*b* form an operating side 216 of poly-scissors device 200, wherein bi-cutting side 214 is situated in an opposite direction relative to operating side 216.

In the configuration presented in FIG. 2, poly-scissors device 200 includes two pairs of cutting ends (204*a* and 204*b*, and 206*a* and 206*b*) forming bi-cutting side 214. Nevertheless, as is understood to those with skills in the art and as shown in FIG. 3, additional pairs of cutting ends, such as, for example, cutting ends 218*a* and 218*b* may be included in element 202*a* and 202*b*, respectively, to form a different poly-cutting side 219 (a tri-cutting side in the example given in FIG. 3) in poly-scissors device 200.

As is understood to those with skills in the art, each of elements 202*a* and 202*b* may be made of a single part which includes two or more cutting ends, a spacer and an operating end. Alternatively, each of elements 202*a* and 202*b* may be made of few parts fixedly attached to one another. In the example given in FIG. 2 the cutting ends (204, 206) and the spacer (205) of each of elements 202*a* and 202*b* are made of a single part 220*a* and 220*b*, to which part 220*a* and 220*b* fixedly attached is operating end, 208*a* and 208*b*, respectively, whereas in the example given in FIG. 3 each of the cutting ends (204, 206), the spacer (205) and the operating end (208) of each of elements 202*a* and 202*b* is a single part.

Fixedly attaching parts to form elements 202*a* and 202*b* may be achieved, for example, by welding the parts to one another, or by any other conventional means for fixedly attaching parts. Nevertheless, when a configuration such as the one exemplified in FIG. 3 is employed, wherein the cutting ends (204, 206, 218) are each made of a single part, poly-scissors 200 may be versatile in the number of cutting ends, which may be added or removed, and in the space between the cutting ends which may be made adjustable by moving the cutting ends (e.g., 204, 206 and 18) one relative to the other along the spacers (205), all according to the needs of a user.

Figure 1:
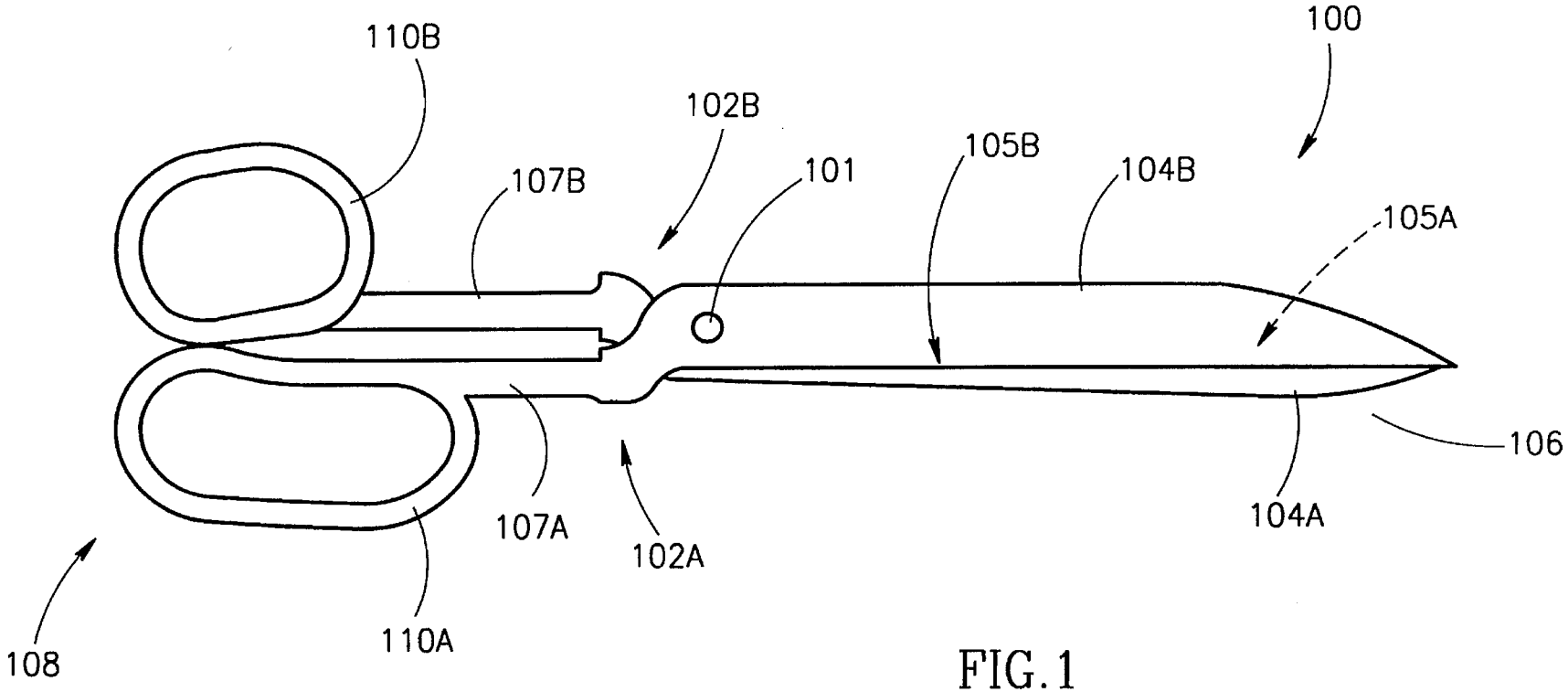
FIG. 1 PRIOR ART
FIG. 1 is a side view of a pair of scissors of the prior art.
Figure 3:
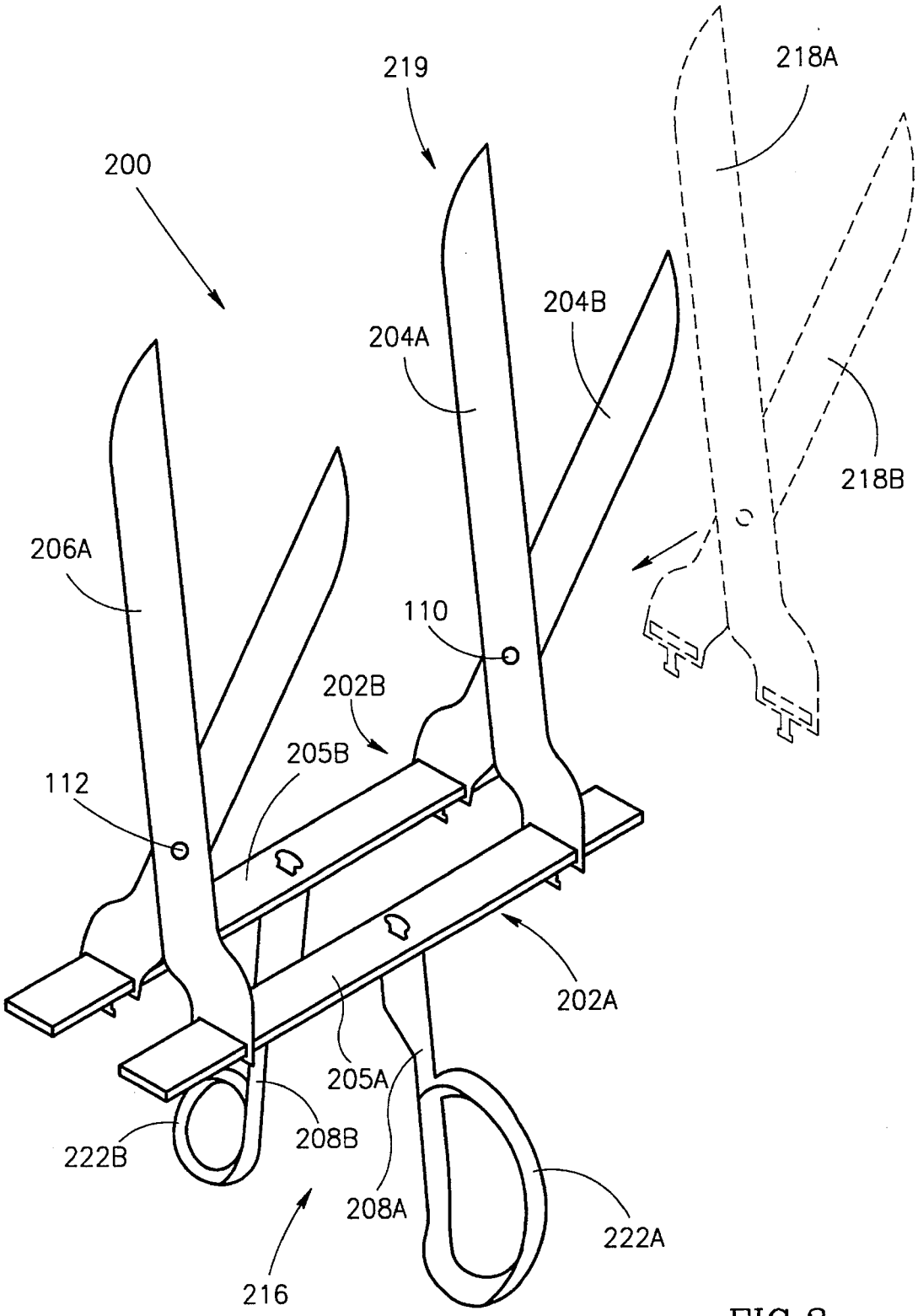
FIG. 3 is a perspective view of a second configuration of a poly-scissors device, according to the present invention.

As shown in FIGS. 2 and 3, each of operating ends 208*a* and 208*b* are preferably constructed similar to operating ends 107*a* and 107*b* of scissors 100 (FIG. 1) to include oval-ringed handles, 222*a* and 222*b*, respectively, to enable the thumb and another finger or fingers (e.g., the pointing finger) of a user to comfortably rotate cutting ends 204*a* and 206*a*, and 204*b* and 206*b*, one relative to the other, around hinges 110 and 112, respectively, thereby to cut a medium, such as, for example, a sheet of paper into ribbons.

Figure 4:
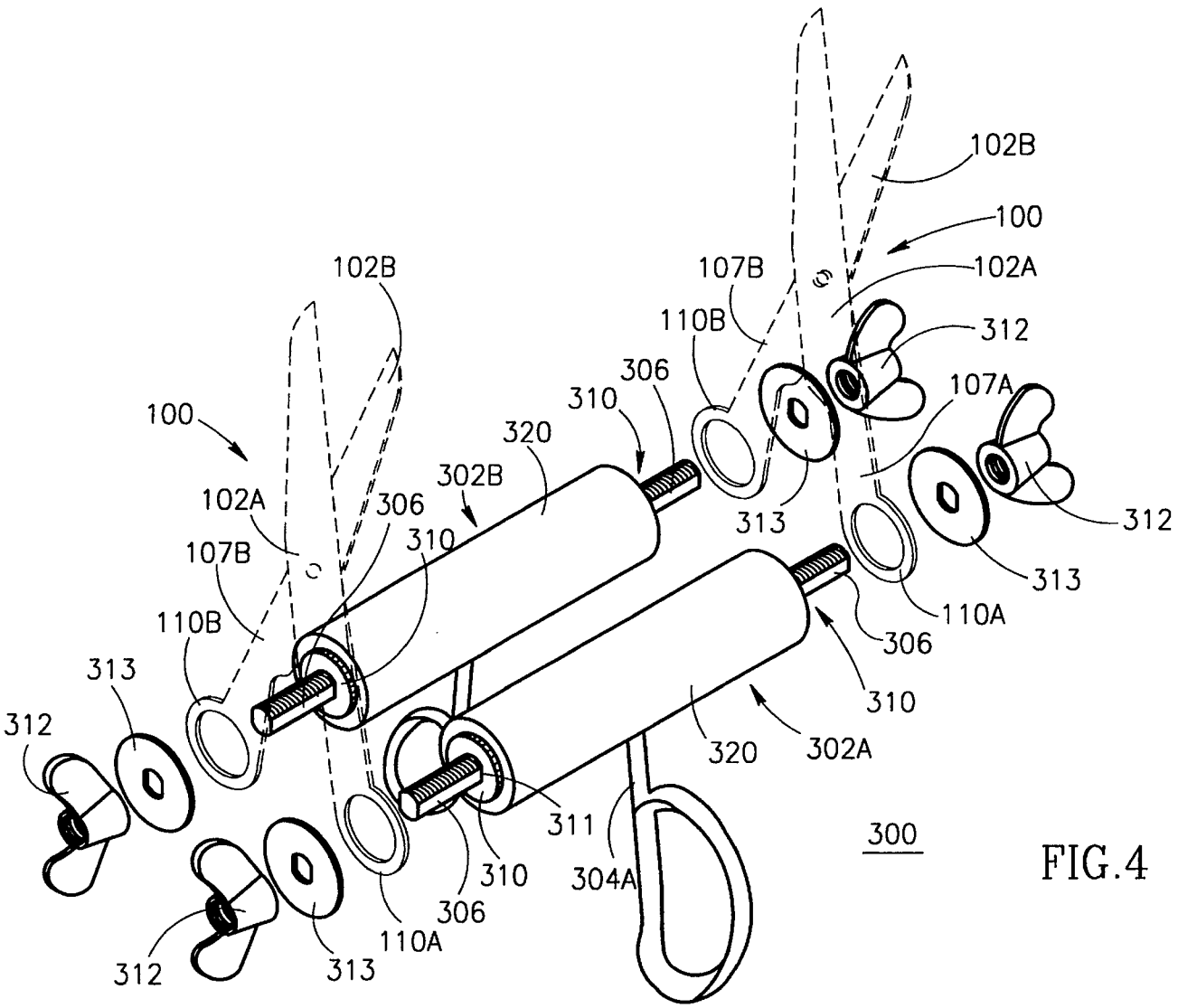
FIG. 4 is a perspective view of a scissors connector, according to the present invention.

Another possible configuration is shown in FIG. 4. According to this configuration, provided is a scissors connector, generally referred to as 300. Scissors connector 300 is aimed at substantially parallel connecting at least two pairs of scissors, each is similar to scissors 100 shown in FIG. 1. As will be detailed below, scissors connector 300, basically functions like spacers 205*a* and 205*b* in poly-scissors device 200, described hereinabove.

As exemplified in FIG. 4, scissors connector 300 includes two connectors 302*a* and 302*b*, each of connectors 302*a* and 302*b* have an operating end 304*a* and 304*b*, similar in structure to the operating ends (208) of poly-scissors device 200 and, each of connectors 302*a* and 302*b* connects first elements 102*a* and second elements 102*b* of two pairs of scissors 100 in a spaced apart and substantially parallel orientation.

As is understood to those with skills in the art, the connections of first elements 102*a* and second elements 102*b* of two pairs of scissors 100 in a spaced apart and substantially parallel orientation may be affected by many alternative strategies, one is presently preferred and is presented in FIG. 4. According to this preferred strategy, two or more pairs of scissors 100 are firmly connected in a substantially parallel and spaced apart orientation to two members 306. A rotation preventing member 310, having a hole 311 to accept threaded spacer 306, and being complementary in shape to oval-ringed handles 110*a* and 110*b* of operating ends 107*a* and 107*b* of each of pair of scissors 100, is inserted into each oval-ringed handle 110*a* and 110*b* of operating ends 107*a* and 107*b* of each of pair of scissors 100. Rotation preventing members 310 built-up is selected complementary in shape to handles 110*a* and 110*b* of operating ends 107*a* and 107*b*, and to connectors 302*a* and 302*b*, to prevent a rotational movement of pairs of scissors 100 relative to members 306 upon operation. In the configuration presented in FIG. 4, spacing pairs of scissors 100 is achieved by cylinders 320 acting as stoppage means to space apart scissors pairs 100. Nevertheless, it is understood that other stoppage means may be employed, such as, but not limited to, nuts, pins, rings etc.

Various types of strengthening means may be employed to strengthen the connection of pairs of scissors 100 to each of members 306. In the example of FIG. 4, for each connection employed is an external ring 313 and an external winged nut 312. In this case connectors 306 are selected to be threaded, at least at their ends. It is understood that similarly, scissors connector 300 may be adapted to enable substantially parallel connecting three or more pairs of scissors.

FIGS. 2 and 3 and FIG. 4 present spacers 205 of poly-scissors device 200 and scissors connector 300, respectively, substantially linear. nevertheless, it is understood that spacers 205 of poly-scissors device 200 and scissors connector 300 may acquire various other forms, such as, but not limited to, bent, curved or broken forms.

It is understood that additional pairs of scissors 100 may be connected similarly by scissors connector 300, depending on the needs of a user. It is also understood that the spacings between thus connected pairs of scissors 100 may be versatile to enable multiple applications.

It is also understood that the cutting ends, according to any of the configurations described hereinabove, may be like those of plain blade scissors, pinking scissors, convex blade scissors and the like.

Hence, the poly-scissors device and the scissors connector of the present invention have an advantage over the presently known configurations, when desired are two or more cuts in a medium, which cuts have a constant linear distance one from the other, such as, when a sheet of paper is cut to linear or curved ribbons.

While the invention has been described with respect to a limited number of embodiments, it will be appreciated that many variations, modifications and other applications of the invention may be made.

What is claimed is:

1. A poly-scissors device capable of simultaneously cutting at least two cuts in a medium, which cuts are at a constant distance from one another along their length, comprising a first element and a second element, wherein:

(a) each of said first and said second elements includes a spacer, a first cutting end, a second cutting end, and an operating end, said first and said second cutting ends connected to said spacer in a substantially parallel and spaced apart orientation and, said operating end connected to said spacer in an opposite direction relative to said first and said second cutting ends; and (b) said first cutting end of said first element is pivotally connected to said first cutting end of said second element, and said second cutting end of said first element is pivotally connected to said second cutting end of said second element.

2. A poly-scissors device as in claim 1, wherein each of said first and said second elements further includes at least one additional cutting end, each of said cutting ends connected to one of said spacers and situated substantially parallel to said first and said second cutting ends.

3. A poly-scissors device as in claim 2, wherein said first cutting end, said second cutting end, said at least one additional cutting end, said spacer and said operating end of each of said first and said second elements are a single part.

4. A poly-scissors device as in claim 2, wherein said first cutting end, said second cutting end, said at least one additional cutting end, said spacer and said operating end of each of said first and said second elements are fixedly attached to one another.

5. A poly-scissors device as in claim 2, wherein said first cutting end, said second cutting end and said at least one additional cutting end of each of said first and said second elements are a first part, said spacer and said operating end of each of said first and said second elements are a second part, said first and said second parts are fixedly attached to one another.

6. A poly-scissors device as in claim 2, wherein said first, said second and said at least one additional cutting ends of each of said first and said second elements are a first part, said spacer and said operating end of each of said first and said second elements are a second and a third parts, respectively, said first, said second and said third parts are fixedly attached to one another.

7. A poly-scissors device as in claim 1, wherein said first and said second cutting ends, said spacer and said operating end of each of said first and said second elements are a single part.

8. A poly-scissors device as in claim 1, wherein said first and said second cutting ends, said spacer and said operating end of each of said first and said second elements are fixedly attached to one another.

9. A poly-scissors device as in claim 1, wherein said first and said second cutting ends of each of said first and said second elements are a first part, said spacer and said operating end of each of said first and said second elements are a second part, said first and said second parts are fixedly attached to one another.

10. A poly-scissors device as in claim 1, wherein said first and said second cutting ends of each of said first and said second elements are a first part, said spacer and said operating end of each of said first and said second elements are a second and a third parts, respectively, said first, said second and said third parts are fixedly attached to one another.

11. A poly-scissors device as in claim 1, wherein said first and said second cutting ends of each of said first and said second elements are movable one relative to the other along said spacers, respectively.

12. A poly-scissors device as in claim 1, wherein said first, said second and said at least one additional cutting ends of each of said first and said second elements are movable one relative to the others along said spacers, respectively.

* * * * *